US008827750B2

(12) United States Patent
Chung et al.

(10) Patent No.: US 8,827,750 B2
(45) Date of Patent: Sep. 9, 2014

(54) APPLICATION STRUCTURE FOR ELECTRIC WAVE EFFECT OF TRANSMISSION CONDUCTOR

(71) Applicant: Kuang Ying Computer Equipment Co., Ltd., New Taipei (TW)

(72) Inventors: Hsuan-Ho Chung, New Taipei (TW); Yu-Hung Lin, New Taipei (TW); Chih-Ming Hsu, New Taipei (TW)

(73) Assignee: Kuang Ying Computer Equipment Co., Ltd., New Taipei (TW)

( * ) Notice: Subject to any disclaimer, the term of this patent is extended or adjusted under 35 U.S.C. 154(b) by 31 days.

(21) Appl. No.: 13/669,463

(22) Filed: Nov. 6, 2012

(65) Prior Publication Data

US 2014/0127942 A1 May 8, 2014

(51) Int. Cl.
*H01R 24/00* (2011.01)

(52) U.S. Cl.
USPC ..... 439/660; 439/676

(58) Field of Classification Search
USPC ..... 439/660, 676
See application file for complete search history.

(56) References Cited

U.S. PATENT DOCUMENTS 7,442,054 B2 * 10/2008 Lemke et al. ..... 439/79
7,867,031 B2 * 1/2011 Amleshi et al. ..... 439/607.08
8,096,832 B2 * 1/2012 Minich et al. ..... 439/607.05
8,137,119 B2 * 3/2012 Stoner ..... 439/108
8,574,011 B2 * 11/2013 Shih ..... 439/660
8,622,771 B2 * 1/2014 Pan ..... 439/660
2009/0011645 A1 * 1/2009 Laurx et al. ..... 439/608
2009/0017682 A1 * 1/2009 Amleshi et al. ..... 439/608
2010/0248552 A1 * 9/2010 He et al. ..... 439/638
2012/0252232 A1 * 10/2012 Buck et al. ..... 439/55
2013/0183869 A1 * 7/2013 Minich et al. ..... 439/686

* cited by examiner

*Primary Examiner* — Gary Paumen
(74) *Attorney, Agent, or Firm* — Leong C. Lei

(57) ABSTRACT

An application structure for an electric wave effect of transmission conductor solves a high frequency crosswalk problem through the following structures. The applicature structure includes at least one transmission conductor, and the application structure includes a first differential signal transmission conductor set, first signal transmission conductor set, second differential signal transmission conductor set, first ground transmission conductor, third differential signal transmission conductor set, second signal transmission conductor set, fourth differential signal transmission conductor set, first power source transmission conductor, second power transmission conductor and second ground transmission conductor. Whereby, the suppression of common mode signals, and the guiding-to-scatter suppression of radio wave interference (RFI), electromagnetic wave interference (EMI), crosstalk and electrostatic discharge (ESD) can be achieved between each two differential signal conductors through the first and second ground transmission conductors depending on the structure components mentioned above.

8 Claims, 7 Drawing Sheets

APPLICATION STRUCTURE FOR ELECTRIC WAVE EFFECT OF TRANSMISSION CONDUCTOR

(A) TECHNICAL FIELD OF THE INVENTION

The present invention relates to a transmission conductor structure, and more particularly to an application structure for an electric wave effect of a transmission conductor, carrying out effectively the suppression of common mode signals, and the guiding-to-scatter suppression of radio wave interference (RFI), electromagnetic wave interference (EMI), crosstalk and electrostatic discharge (ESD).

(B) DESCRIPTION OF THE PRIOR ART

Currently, connectors are very popular. Among these, USB connectors are improved, developed continuously, and the transmission speed thereof increases as well.

However, crosstalk may influence the high frequency transmission of differential signals. Especially, a time differential signal pair and a differential signal pair, or a differential signal pair and a signal pair will subject to crosstalk, causing the instability of the signal transmission upon the high frequency transmission of a connector. Therefore, ground terminals are used for a portion of terminals of an electronic connector to block crosstalk generated among signal terminals and prevent the influence to the transmission speed and high frequency signals of the electronic connector itself. However, the suppression of electromagnetic wave interference is carried out on conventional connectors all by means of traditional shielding.

SUMMARY OF THE INVENTION

To improve the defects mentioned above, an application structure for an electric wave effect of a transmission conductor with which the suppression of common mode signals, and the guiding-to-scatter suppression of radio wave interference (RFI), electromagnetic wave interference (EMI), crosstalk and electrostatic discharge (ESD) are carried out as proposed.

The main object of the present invention is to provide an application structure for an electric wave effect of a transmission conductor, achieving the effective suppression of common mode signals, and guiding-to-scatter suppression of radio wave interference (RFI), electromagnetic wave interference (EMI), crosstalk and electrostatic discharge (ESD) through the collocation and combination of a first ground transmission conductor and second ground transmission conductor with each high frequency terminal and low frequency terminal, and the coupling thereof to each other.

To achieve the object mentioned above, the present invention proposes an application structure for an electric wave effect of a transmission conductor, capable of solving the problem caused by high frequency crosstalk through the following structure; the structure includes at least one transmission conductor, which includes a first transmission conductor set, where the first transmission conductor set includes a first differential signal transmission set, first signal transmission set and second differential signal transmission conductor set arranged parallel to one another, where common mode signal interference generated from the first differential signal transmission conductor set and second differential signal transmission conductor set is suppressed through a first ground transmission conductor and first power source transmission conductor, and the first transmission conductor is in electric connection with a second transmission conductor set, which includes a third differential signal transmission conductor set, second signal transmission conductor set and fourth differential signal transmission conductor set, where common mode signal interference generated from the third differential signal transmission conductor set and fourth differential signal transmission conductor set is suppressed through a second ground transmission conductor and second power source transmission conductor.

Furthermore, the transmission conductor defines at least one contact portion, bended portion and welded portion with a respective angle ranging from 120 to 150 degrees.

Whereby, the collocated actuation among the first ground transmission conductor, second ground transmission conductor, first power source transmission conductor and second power source transmission conductor allows the best suppression of common mode signals, and guiding-to-scatter suppression of radio wave interference (RFI), electromagnetic wave interference (EMI), crosstalk and electrostatic discharge (ESD).

BRIEF DESCRIPTION OF THE DRAWINGS

FIG. 3 is a plan view of the embodiment of the present invention; and.

DETAILED DESCRIPTION OF THE PREFERRED EMBODIMENTS

Figure 1:
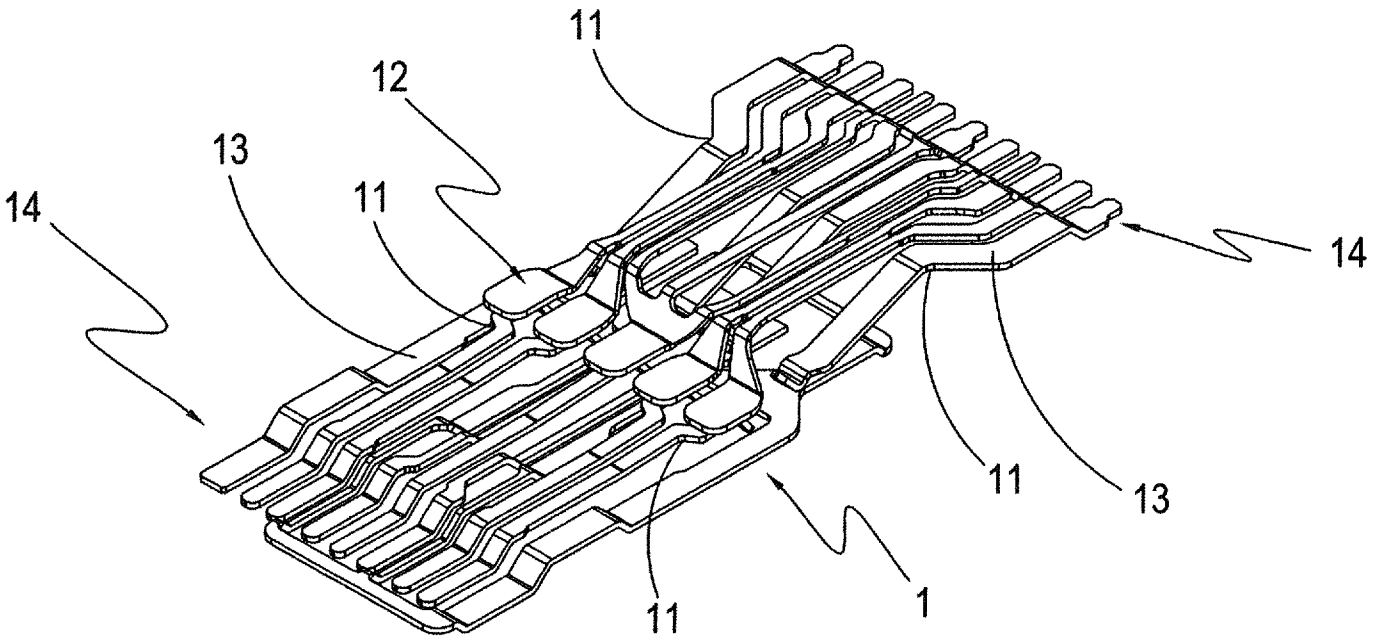
FIG. 1 is a perspective view illustrating a preferred embodiment of the present invention.
Figure 2:
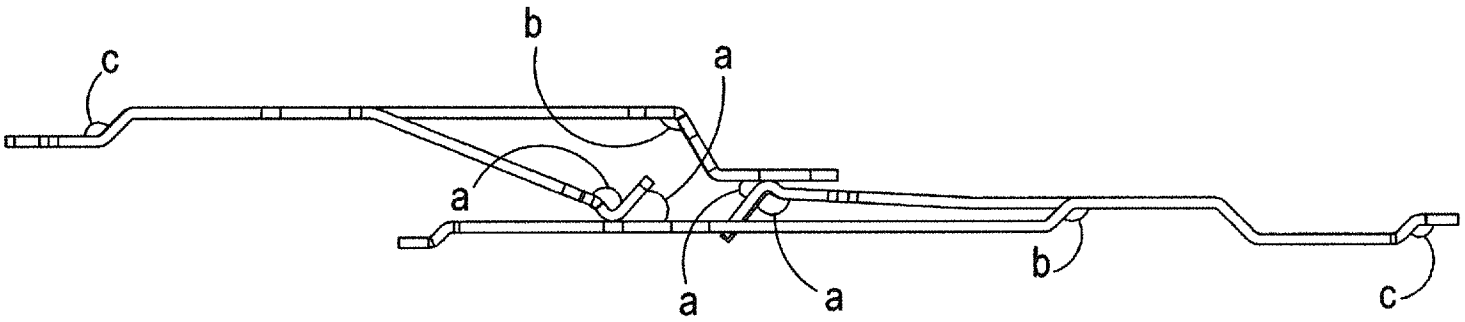
FIG. 2 is a side view illustrating the embodiment of the present invention.
Figure 2A:
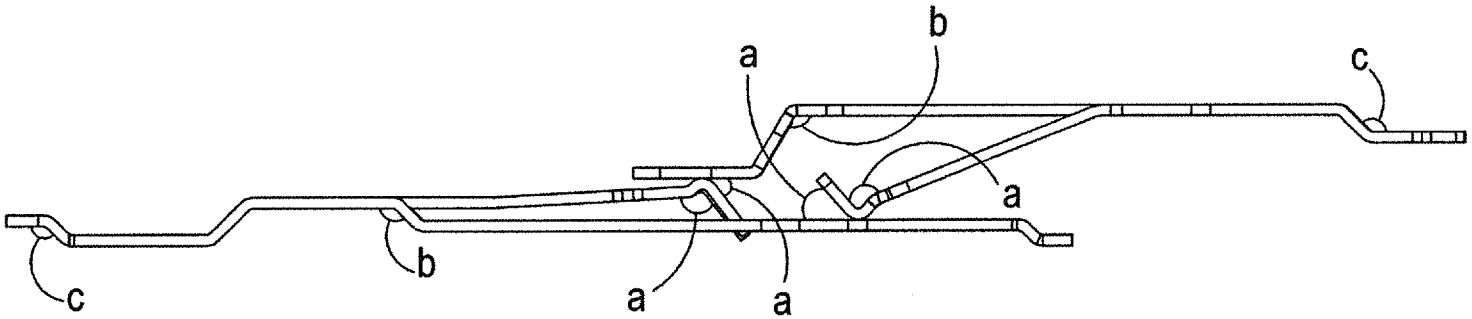
FIG. 2A is another side view illustrating the embodiment of the present invention.
Figure 2B:
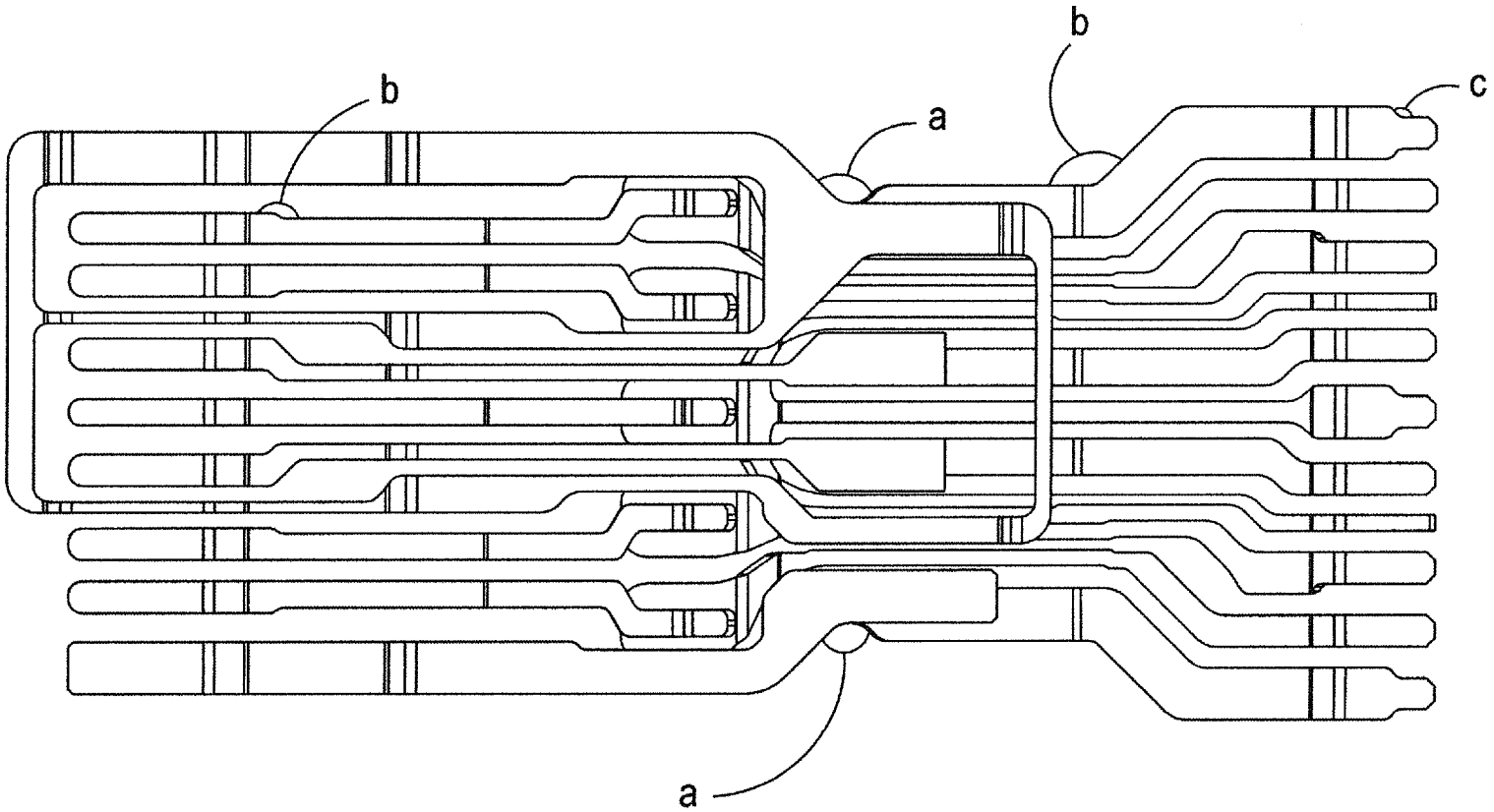
FIG. 2B is still another side view illustrating the embodiment of the present invention.
Figure 2C:
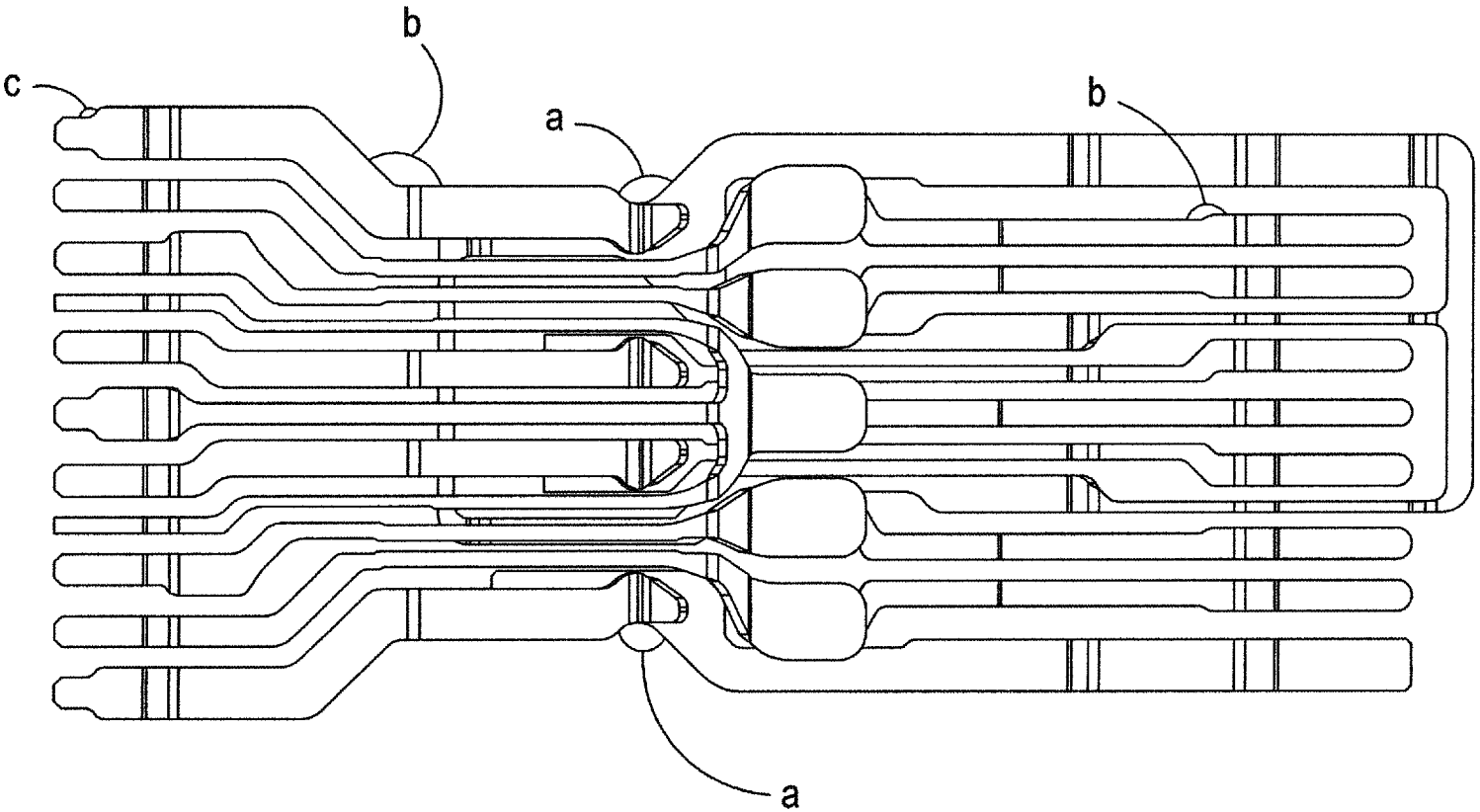
FIG. 2C is yet another side view illustrating the embodiment of the present invention.

Referring to FIGS. 1 to 2C, illustrating respectively perspective and plan views of a preferred embodiment of the present invention. It is clearly seen that an application structure for an electric wave effect of a transmission conductor of the present invention includes at least one transmission conductor, including at least bended portion 11 with an angle ranging from 120 to 150 degrees. Furthermore, referring to FIG. 4 as well, an angle a and the transmission conductor 1 define at least one contact portion 12 with an angle ranging form 120 to 150 degrees, an angle b and the transmission conductor 1 at least one base 13 with an angle ranging form 120 to 150 degrees, and an angle c and the transmission conductor 1 at least one welded portion 14 with an angle ranging form 120 to 150 degrees.

Figure 3:
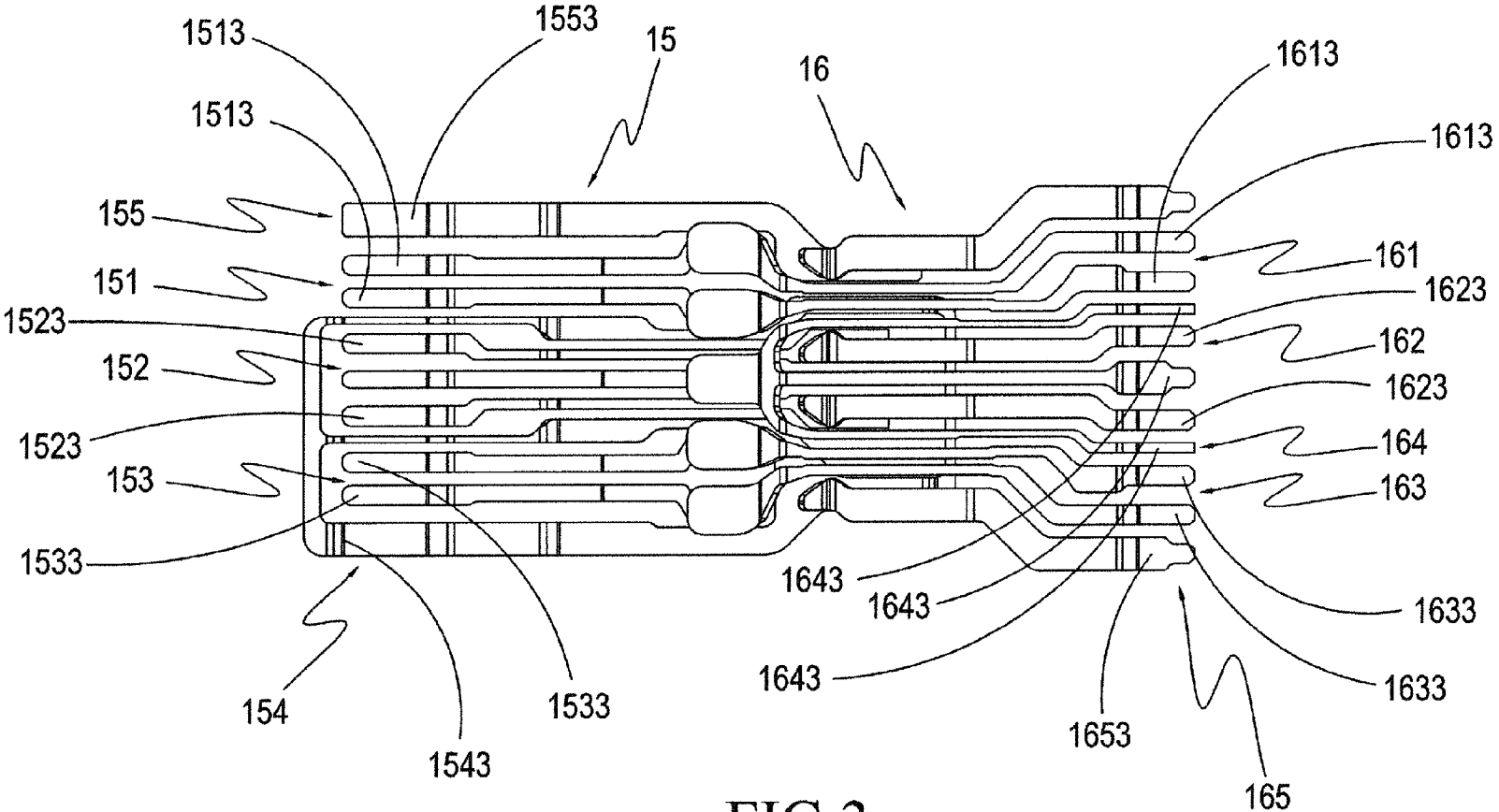
Figure 4:
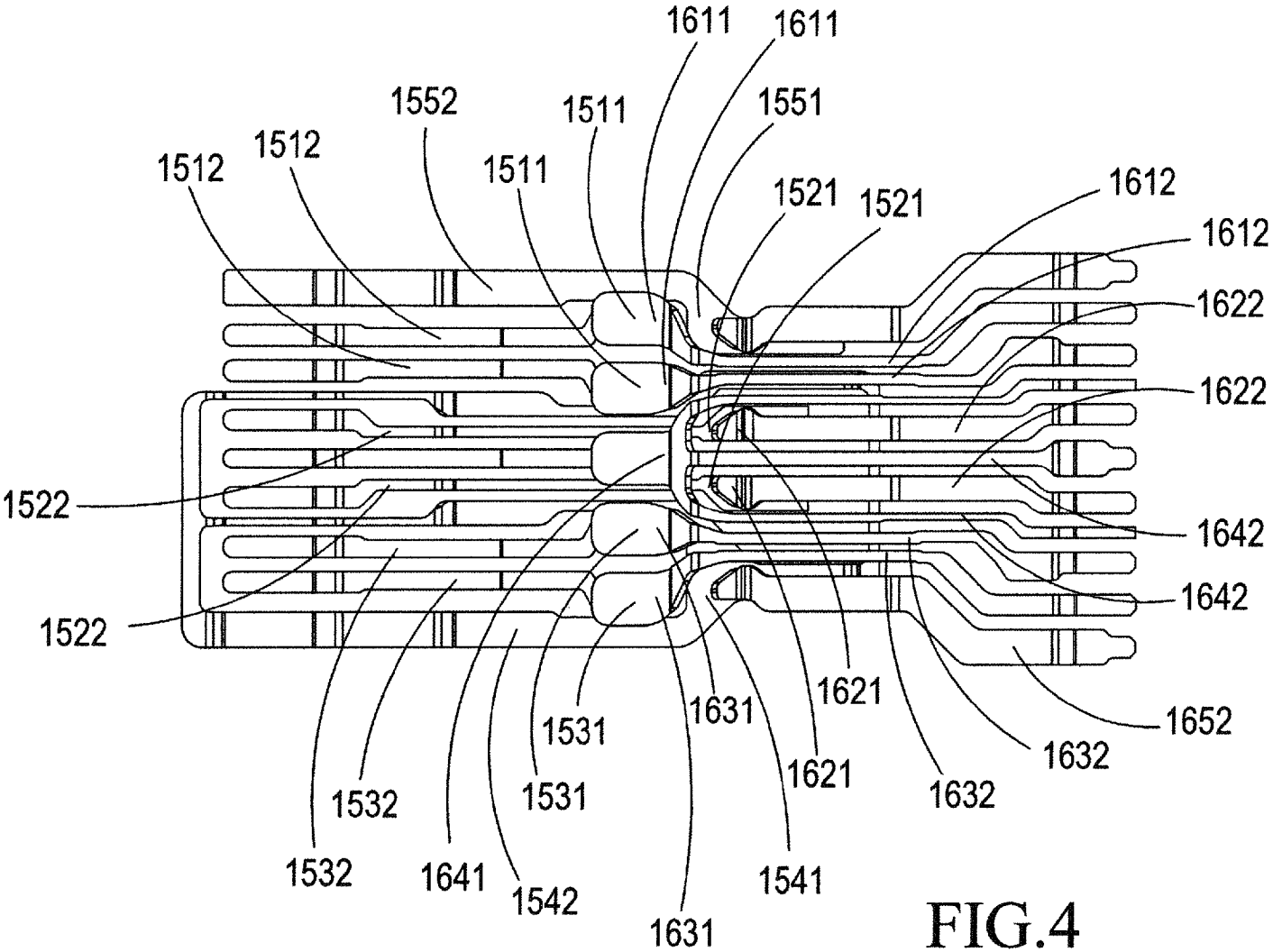
FIG. 4 is another plan view of the embodiment of the present invention.

Referring to FIGS. 3 and 4, illustrating respectively a plan view of this embodiment of the present invention, it is clearly seen from the figures that the application structure for an electric wave effect of a transmission conductor includes at least on transmission conductor; each thereof includes a first transmission conductor set 15 and second transmission conductor set 16.

The first transmission conductor set 15 includes a first differential signal transmission conductor set 151, first signal transmission conductor set 152 and second differential signal transmission conductor set 153 arranged parallel to one another, and the common mode signal interference or crosstalk generated from the first differential signal transmission conductor set 151 and second differential signal transmission conductor set 153 is suppressed or isolated through a first ground transmission conductor 154 and first power source transmission conductor 155.

The second transmission conductor set 16 is electrically connected to the first transmission conductor set 15, and includes a third differential signal transmission conductor set 161, second signal transmission conductor set 162 and fourth differential signal transmission conductor set 163 arranged parallel to one another, and the common mode signal interference or crosstalk generated from the third differential signal transmission conductor set 161 and fourth differential signal transmission conductor set 163 is suppressed or isolated through a second ground transmission conductor 164 and second power source transmission conductor 165.

With respect to the isolation, referring to FIGS. 2 to 4, which respectively are side views and plan vies of this embodiment of the present invention, the first differential signal transmission conductor set 151, first signal transmission conductor set 152, second differential signal transmission conductor set 153, first ground transmission conductor 154, third differential signal transmission conductor set 161, second signal transmission conductor set 162, fourth differential signal transmission conductor set 163, first power source transmission conductor 155, second power transmission conductor 165 and second ground transmission conductor 164 respectively define a first differential signal contact portion 1511, first signal contact portion 1521, second differential signal contact portion 1531, first ground contact portion 1541, third differential signal contact portion 1611, second signal contact portion 1624, fourth differential signal contact portion 1631, first power source contact portion 1551, second power source contact portion 1651 and second ground contact portion 1641. In addition, the first differential signal contact portion 1511 and second signal contact portion 1621 carry out the isolation (common mode signal interference suppression or crosstalk isolation) through the first ground contact portion 1541 and second ground contact portion 1641, and the second differential signal contact portion 1531 and second signal contact portion 1621 carry out the isolation (common mode signal interference suppression or crosstalk isolation) through the first ground contact portion 1541 and second ground contact portion 1641.

Furthermore, the first differential signal transmission conductor set 151, first signal transmission conductor set 152, second differential signal transmission conductor set 153, first ground transmission conductor 154, third differential signal transmission conductor set 161, second signal transmission conductor set 162, fourth differential signal transmission conductor set 163, first power source transmission conductor 155, second power transmission conductor 165 and second ground transmission conductor 164 respectively define a first differential signal base 1512, first signal base 1522, second differential signal base 1532, first ground base 1542, third differential signal base 1612, second signal base 1622, fourth differential signal base 1632, first power source base 1552, second power source base 1652 and second ground base 1642. In addition, the first differential signal base 1512 and second signal base 1622 carry out the isolation (common mode signal interference suppression or crosstalk isolation) through the first ground base 1542 and second ground base 1642, and the second differential signal base 1532 and second signal base 1622 carry out the isolation (common mode signal interference suppression or crosstalk isolation) through the first ground base 1542 and second ground base 1642.

Furthermore, the first differential signal transmission conductor set 151, first signal transmission conductor set 152, second differential signal transmission conductor set 153, first ground transmission conductor 154, third differential signal transmission conductor set 161, second signal transmission conductor set 162, fourth differential signal transmission conductor set 163, first power source transmission conductor 155, third power source transmission conductor 165 and second ground transmission conductor 164 respectively define a first differential signal welded portion 1513, first signal welded portion 1523, second differential signal welded portion 1533, first ground welded portion 1543, third differential signal welded portion 1613, second signal welded portion 1623, fourth differential signal welded portion 1633, first power source welded portion 1553, second power source welded portion 1653 and second ground welded portion 1643. In addition, the first differential signal welded portion 1513 and second signal welded portion 1623 carry out the isolation (common mode signal interference suppression or crosstalk isolation) through the first ground welded portion 1543 and second ground welded portion 1643, and the second differential signal welded portion 1533 and second signal welded portion 1623 carry out the isolation (common mode signal interference suppression or crosstalk isolation) through the first ground welded portion 1543 and second ground welded portion 1643.

We claim:

1. An application structure for an electric wave effect of a transmission conductor, comprising at least one transmission conductor, and said transmission conductor comprising:

a first transmission conductor set, comprising a first differential signal transmission conductor set, first signal transmission conductor set and second differential signal transmission conductor set arranged parallel to one another, and a first ground transmission conductor adapted to carry out crosstalk isolation being disposed among said first differential signal transmission conductor set, first signal transmission conductor set and second differential signal transmission conductor; and a second transmission conductor set, in electric connection with said first transmission conductor set, comprising a third differential signal transmission conductor set, second signal transmission conductor set and fourth differential signal transmission conductor set arranged parallel to one another, and a second ground transmission conductor adapted to carry out crosstalk isolation being disposed among said third differential signal transmission conductor set, second signal transmission conductor set and fourth differential signal transmission conductor set.

2. The application structure according to claim 1, wherein said first differential signal transmission conductor set, first signal transmission conductor set, second differential signal transmission conductor set, first ground transmission conductor, third differential signal transmission conductor set, second signal transmission conductor set, fourth differential signal transmission conductor set and second ground transmission conductor respectively define a first differential signal contact portion, first signal contact portion, second differential signal contact portion, first ground contact portion, third differential signal contact portion, second signal contact portion, fourth differential signal contact portion and second ground contact portion; furthermore, said first differential signal contact portion and second signal contact portion carry out crosstalk isolation through said first ground contact portion and second ground contact portion, and said second differential signal contact portion and second signal contact portion carry out crosstalk isolation through said first ground contact portion and second ground contact portion.

3. The application structure according to claim 1, wherein said first differential signal transmission conductor set, first signal transmission conductor set, second differential signal transmission conductor set, first ground transmission conductor, third differential signal transmission conductor set, second signal transmission conductor set, fourth differential signal transmission conductor set and second ground transmission conductor respectively define a first differential signal base, first signal base, second differential signal base, first ground base, third differential signal base, second signal base, fourth differential signal base and second ground base; furthermore, said first differential signal base and second signal base carry out crosstalk isolation through said first ground base and second ground base, and said second differential signal base and second signal base carry out crosstalk isolation through said first ground base and second ground base.

4. The application structure according to claim 1, wherein said first differential signal transmission conductor set, first signal transmission conductor set, second differential signal transmission conductor set, first ground transmission conductor, third differential signal transmission conductor set, second signal transmission conductor set, fourth differential signal transmission conductor set and second ground transmission conductor respectively define a first differential signal welded portion, first signal welded portion, second differential signal welded portion, first ground welded portion, third differential signal welded portion, second signal welded portion, fourth differential signal welded portion and second ground welded portion; furthermore, said first differential signal welded portion and second signal welded portion carry out crosstalk isolation through said first ground welded portion and second ground welded portion, and said second differential signal welded portion and second signal welded portion carry out crosstalk isolation through said first ground welded portion and second ground welded portion.

5. An application structure for an electric wave effect of a transmission conductor, comprising at least one transmission conductor, and said transmission conductor comprising:

a first transmission conductor set, comprising a first differential signal transmission conductor set, first signal transmission conductor set and second differential signal transmission conductor set arranged parallel to one another, and common mode signal interference generated from said first differential signal transmission conductor set and second differential signal transmission conductor set being suppressed through a first ground transmission conductor and first power source transmission conductor; and a second transmission conductor set, in electric connection with said first transmission conductor set, comprising a third differential signal transmission conductor set, second signal transmission conductor set and fourth differential signal transmission conductor set arranged parallel to one another, and common mode signal interference generated from said third differential signal transmission conductor set and fourth differential signal transmission conductor set being suppressed through a second ground transmission conductor and second power source transmission conductor.

6. The application structure according to claim 5, wherein said first differential signal transmission conductor set, first signal transmission conductor set, second differential signal transmission conductor set, first ground transmission conductor, third differential signal transmission conductor set, second signal transmission conductor set, fourth differential signal transmission conductor set, first power source transmission conductor, second power source transmission conductor and second ground transmission conductor respectively define a first differential signal contact portion, first signal contact portion, second differential signal contact portion, first ground contact portion, third differential signal contact portion, second signal contact portion, fourth differential signal contact portion, first power source contact portion, second power source contact portion and second ground contact portion; furthermore, said first differential signal contact portion and second signal contact portion carry out common mode signal interference suppression through said first ground contact portion and second ground contact portion, and said second differential signal contact portion and second signal contact portion carry out crosstalk isolation through said first ground contact portion and second ground contact portion.

7. The application structure according to claim 5, wherein said first differential signal transmission conductor set, first signal transmission conductor set, second differential signal transmission conductor set, first ground transmission conductor, third differential signal transmission conductor set, second signal transmission conductor set, fourth differential signal transmission conductor set, first power source transmission conductor, second power source transmission conductor and second ground transmission conductor respectively define a first differential signal base, first signal base, second differential signal base, first ground base, third differential signal base, second signal base, fourth differential signal base, first power source base, second power source base and second ground base; furthermore, said first differential signal base and second signal base carry out common mode signal interference suppression through said first ground base and second ground base and said second differential signal base and second signal base carry out common mode signal interference suppression through said first ground base and second ground base.

8. The application structure according to claim 5, wherein said first differential signal transmission conductor set, first signal transmission conductor set, second differential signal transmission conductor set, first ground transmission conductor, third differential signal transmission conductor set, second signal transmission conductor set, fourth differential signal transmission conductor set, first power source transmission conductor, second power source transmission conductor and second ground transmission conductor respectively define a first differential signal welded portion, first signal welded portion, second differential signal welded portion, first ground welded portion, third differential signal welded portion, second signal welded portion, fourth differential signal welded portion, first power source welded portion, second power source welded portion and second ground welded portion; furthermore, said first differential signal welded portion and second signal welded portion carry out common mode signal interference suppression through said first ground welded portion and second ground welded portion, and said second differential signal welded portion and second signal welded portion carry out common mode signal interference suppression through said first ground welded portion and second ground welded portion.

* * * * *